United States Patent [19]

Commers

[11] Patent Number: 4,478,400

[45] Date of Patent: Oct. 23, 1984

[54] ENVELOPE FEEDER FOR A DUPLICATING PRESS

[75] Inventor: Louis P. Commers, Melrose Park, Ill.

[73] Assignee: Suburban Duplicator Repair, Inc., Franklin Park, Ill.

[21] Appl. No.: 379,732

[22] Filed: May 19, 1982

[51] Int. Cl.[3] ..... B65H 5/22

[52] U.S. Cl. ..... 271/3.1; 271/5; 271/6; 271/35; 271/157; 271/212; 271/265

[58] Field of Search ..... 271/3.1, 6, 35, 157, 271/212, 265, 5

[56] References Cited

U.S. PATENT DOCUMENTS 2,635,874 4/1953 LeBore ..... 271/35
3,612,511 10/1971 Godlewski ..... 271/35
3,998,451 12/1976 McInerny ..... 271/212
4,369,959 1/1983 Hornbuckle ..... 271/3.1

*Primary Examiner*—Richard A. Schacher
*Attorney, Agent, or Firm*—Lee, Smith & Zickert

[57] ABSTRACT

An envelope feeder for a duplicating press having a suction feeder wherein the envelope feeder includes a conveyer for transferring envelopes one at a time from a magazine storing a supply stack to a feed stack from which the suction feeder of the duplicating press removes the envelopes one at a time from the top of the stack. The conveyer coacts with the magazine and other means for taking the envelopes from the bottom of the supply stack one at a time and feeding them to the bottom of the feed stack at the press. A detector at the feed stack shuts down the conveyer when the feed stack reaches a predetermined height, and thereafter starts the conveyer when the stack diminishes to a given level.

15 Claims, 10 Drawing Figures

ENVELOPE FEEDER FOR A DUPLICATING PRESS

This invention relates in general to an envelope feeder for a duplicating press, and more particularly to an envelope feeder for delivering envelopes to a suction feeder of a duplicating press, and still more particularly to an envelope feeder of simple construction and which provides a feed stack of envelopes at the press.

Heretofore, there have been a number of envelope feeders available for use with duplicating presses having suction feeders. A suction feeder on a duplicating press serves to take the stock from a stack and deliver it into the printing station of the press. The known envelope feeders have been complex in structure and rather bulky and difficult to handle, which required considerable time in order to place them into functioning relationship with a duplicating press. Some have required the necessity to be timed with the suction feed cycle of the duplicating press. All known feeders have utilized a horizontal path feed and have also been floor supported, which lends to their bulky and complex structure. Because of their complexity, they have been high in cost and difficult to maintain in continual operation.

The envelope feeder of the present invention overcomes the difficulties and disadvantages known to envelope feeders presently being marketed. The feeder of the present invention includes a structure that is easily mounted onto the vertically movable stack platform of the duplicating press to automatically position it relative to the suction feeder. Because a feed stack is maintained at the suction feeder thereby always assuring a supply of envelopes to the suction feeder, it is not at all necessary to be concerned about timing the operation of the feeder of the present invention to the duplicating press as that is accomplished automatically upon mounting it on the duplicating press. A magazine for storing a supply of envelopes in a supply stack is disposed at the input end of the envelope feeder of the invention. A feed stack is developed and maintained at the output end from the top of which the suction feeder of the duplicating machine removes envelopes one at a time. A continuously driven conveyer coacts with a metering device at the output side of the magazine to cause single envelopes to be discharged from the magazine one at a time and in a stream one at a time to the feed stack, thereby minimizing jamming. An inclined path is defined by the conveyer between the magazine and the feed stack so that envelopes going to the feed stack are added to the stack at the bottom thereof. A stack height detector is provided at the feed stack which, when it detects a predetermined stack height, will stop the conveyer and thereafter start the conveyer when the height has dropped below a certain level. Accordingly, the feed stack is maintained at a level to always provide envelopes for the suction feeder. While the envelope feeder is described herein to be useful for handling envelope stock, it may also be used for other multi-layered stock or for a single layer stock. However, it is well known that envelopes are difficult to feed because they normally have a heavier thickness in the area of the flap. When the word "envelope" is used herein, it is intended to cover other types of stock that are difficult to feed to a press and especially which would be multi-layered in nature.

It is therefore an object of the present invention to provide a new and improved envelope feeder for use with duplicating presses having suction feeders.

It is a further object of the present invention to provide a new and improved envelope feeder which is simple in construction and has a minimum number of parts and therefore economical to manufacture and to maintain.

A still further object of the present invention is in the provision of an envelope feeder for a duplicating press which can be quickly and easily mounted on the press within a few seconds and be ready to operate without necessitating the timing of the feeder with the press.

Another object of the present invention is in the provision of an envelope feeder which is adjustable to handle envelopes of various sizes and which feeds envelopes one at a time from a supply stack to a feed stack at a higher level and maintains the feed stack at a predetermined height.

Other objects, features and advantages of the invention will be apparent from the following detailed disclosure, taken in conjunction with the accompanying sheets of drawings, wherein like reference numerals refer to like parts, in which.

Figure 1:
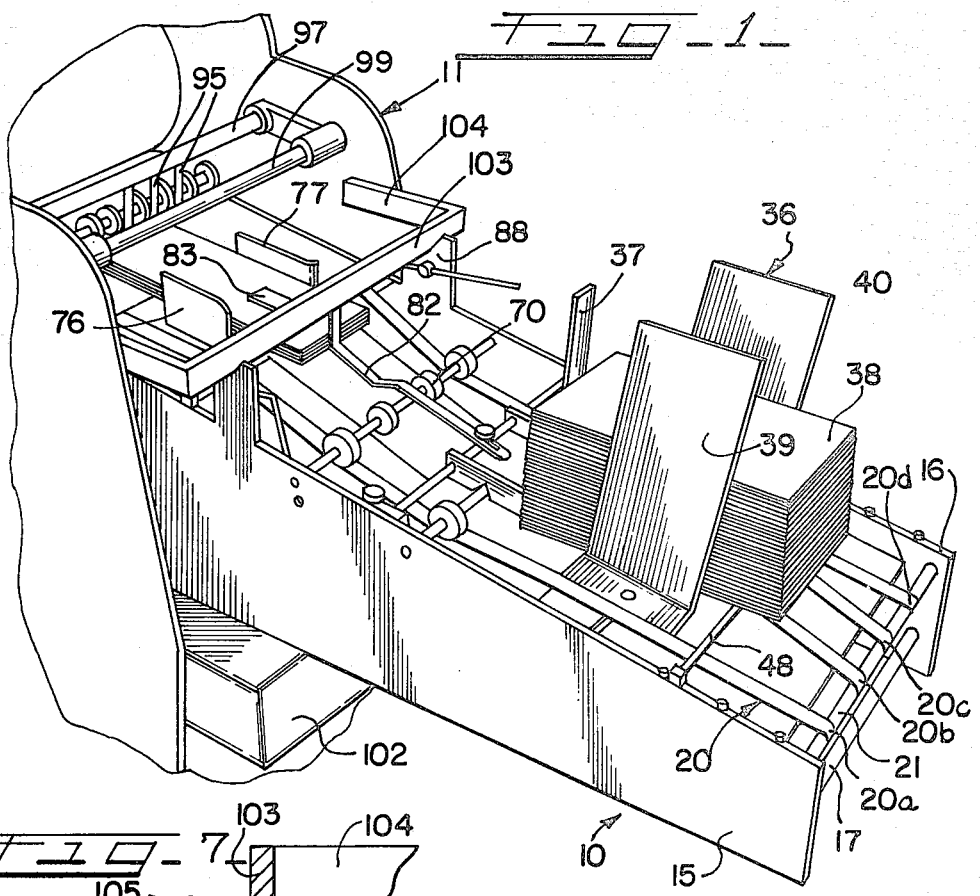
FIG. 1 is a fragmentary perspective view of a duplicating press and a perspective view of the envelope feeder of the present invention mounted on the press.

Referring now to the drawings, and particularly to FIG. 1, the envelope feeder of the present invention, generally designated by the numeral 10, is illustrated in mounted position on a duplicating press 11. As will be more clearly hereinafter explained, the envelope feeder 10 may be quickly and easily mounted on or dismounted from the duplicating press. It will be further appreciated that while the envelope feeder is illustrated as being mounted on a particular type of duplicating press, it can be mounted on and used with any type of duplicating press having a top suction feeder.

Figure 2:
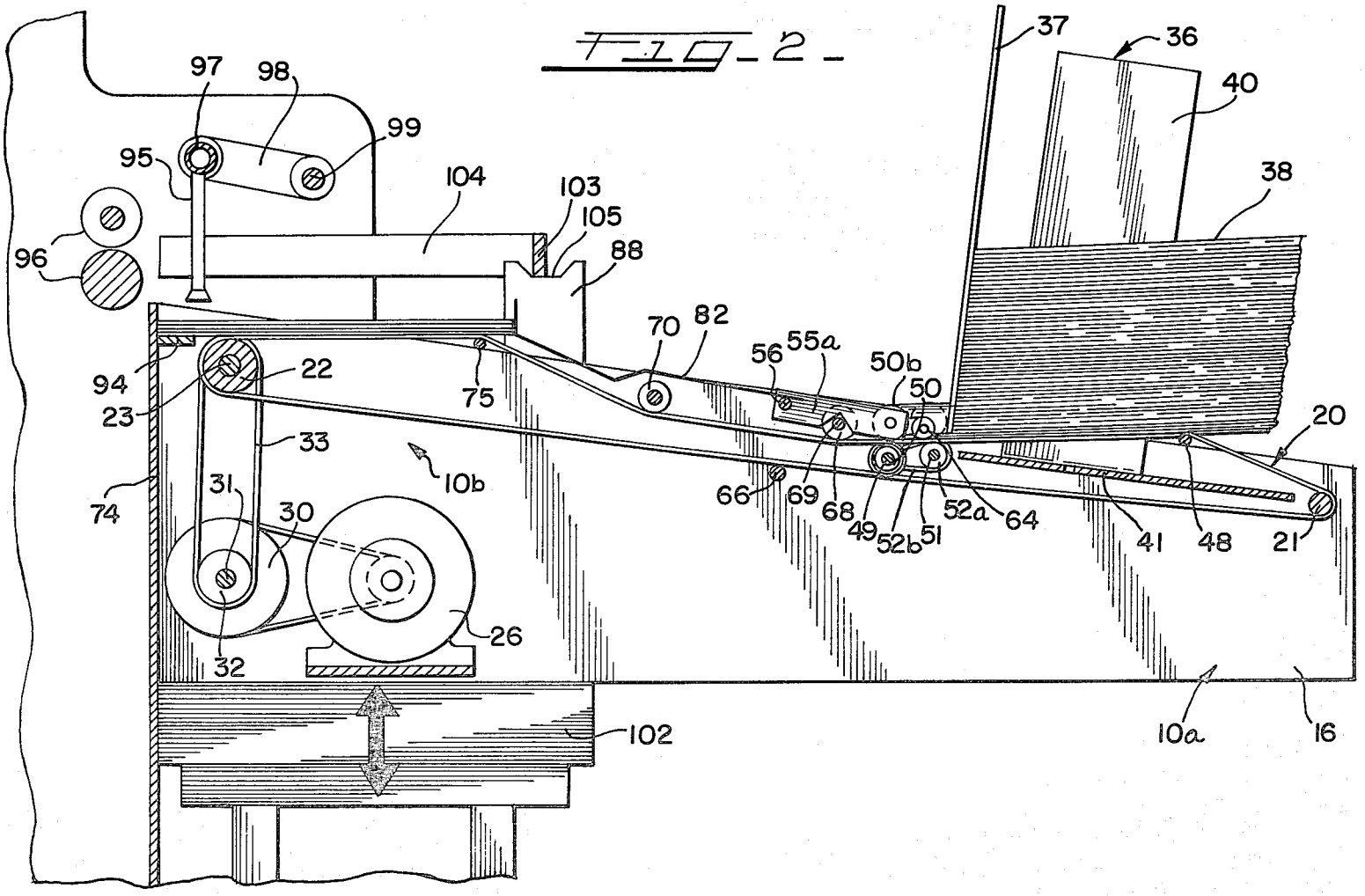
FIG. 2 is a side elevational schematic diagram of the feeder of the present invention to illustrate the operation and also the manner in which it is mounted on a duplicating press.

The envelope feeder 10 includes a frame composed generally of a pair of vertically extending parallel spaced side rails or support plates 15 and 16 secured together by a plurality of suitable stringers or rods such as the rod 17 shown in FIG. 1. The side rails and rods coact to define a frame. The top edges of the side rails extend from the input end 10*a* to the output end 10*b* (FIG. 2) at a gradual upward incline, while the bottom edges extend horizontally. Likewise, a belt conveyer 20 is supported between the side rails 15 and 16 and extends from the input end 10*a* at an upward incline toward the output end 10*b*. The conveyer 20 includes a plurality of belts 20*a*, 20*b*, 20*c* and 20*d*, thereby giving the conveyer a stranded belt configuration. However, a greater or lesser number of belts may be used. As seen in FIG. 2, the belts are trained over an end roller or bar 21 supported between the side rails 15 and 16 and at the output end 10*a* around a drive roller or pulley 22, which is in turn supported on a shaft 23 bearingly carried by the side rails 15 and 16. Guide rollers and guide bars are carried by the support plates intermediate the input and output ends of the feeder for additionally guiding the path of the belts.

The drive roller 22 is driven by an electric motor 26 which is suitably supported between the side rails 15 and 16. The motor 26 may have multiple speeds to give the desired conveyer speed and envelope feed for a particular job, which may depend on the speed of the duplicator. The motor 26 drives a shaft 27 on which a drive pulley 28 is mounted and over which a drive belt 29 extends and is additionally trained over a driven pulley 30 mounted on a shaft 31 extending between the side rails. A smaller pulley 32 is also mounted on the shaft 31 and over which is trained a drive belt 33 which is additionally trained over the drive roller 22. The pulleys 30 and 32 act as a speed reducer between the motor and the drive roller 22. Thus, energization of the motor 26 commences operation of the conveyer belts such that the top run moves in the direction from the input end of the feeder to the output end.

A magazine 36 for storing a supply stack of envelopes at the input end 10*a*, as seen particularly in FIGS. 1, 2, 3 and 5, includes a transversely extending upstanding front wall 37 against which the leading edges of the envelopes 38 abut. While the front wall 37 may be of any suitable width, less friction is generated with the envelopes when it is narrower than the envelopes, thereby inhibiting hangup on the front wall as the stack diminishes in height. It also may be made of a wire structure where two or more connected vertical wires would define line contact with the envelope edges, or a plate having vertical ridges engaging the envelopes. A pair of upstanding and parallel spaced apart side walls 39 and 40 coact with the front wall 37 to define the magazine 36. The front wall 37 is suitably secured at its lower end as will be later explained such that it may be adjustably positioned to accommodate envelopes of various thicknesses. The side walls 39 and 40 are adjustably mounted on a support plate 41 which is in turn secured at opposite ends to the opposed side rails 15 and 16. Slots are formed in the support plate 41 to receive fasteners also associated with the side walls 39 and 40 to allow for movement of the side walls 39 and 40 toward and away from the side rails 15 and 16 so as to accommodate the desired size of envelope. It therefore can be appreciated that the magazine 36 may be adjustably sized to handle any desired envelope stock within the overall size limitations of the feeder.

The bottom of the magazine 36 is formed by one or more of the conveyer belts depending on the width desired. With respect to the illustrated envelope, the shortest dimension is disposed between the side walls 39 and 40 and of a size needing only three of the five belts of the conveyer. A belt guide 48 is mounted between the side rails 15 and 16 beneath the envelopes slightly inward from the trailing edges thereof and over which the belts 20*b* and 20*c* are trained at a position above the support plate 41. It will be appreciated that the belt guide 48 may be moved toward or away from the input end 10*a* depending upon the length of the envelope being fed by the envelope feeder. While any suitable means may be used for supporting the belt guide, it may be carried between blocks seating on the top edges of the side rails 15 and 16 ahead of which are mounted pins to prevent movement toward the output end of the feeder. The belts will hold the guide down and the forward movement will urge it toward the output end. Pins may also be provided in the support blocks for the belt guide to prevent lateral as well as back-and-forth movement.

At the forward end of the magazine 36, metering means is provided to coact with the front wall 37 and the belts 20 to allow only a single envelope to be discharged from the bottom of the envelope stack at any one time, so that the envelopes move from the magazine 36 to the output end of the feeder in single file or one at a time.

The metering means includes lower roller means and upper guide means positioned just downstream of the front wall 37 or just ahead of the bottom end or edge of the front wall 37. More particularly, a first shaft 49 suitably rotatably mounted at opposite ends in the side rails 15 and 16 includes belt guide rollers 50, one for each of the belts and in engagement with those belts, together with envelope feed rollers 50*a*, 50*b* and 50*c* which are positioned between the two center belts. Rollers 50*a* and 50*c* are preferably serrated on their periphery to enhance gripping relationship with an envelope, although any of the rollers may be serrated if additional gripping is needed. Each of the rollers 50 is preferably of a rubber or elastomeric material and fitted onto the shaft 49 so that they will rotate with the shaft. Since rollers 50 engage the belts, the shaft is driven by the movement of the belts and the engagement of these rollers which then in turn automatically drives the feed rollers 50*a*, 50*b* and 50*c*. Positioned behind shaft 49 toward the magazine but on the same horizontal plane is a second shaft 51. This shaft is also rotatably mounted in the side rails 15 and 16 and includes thereon a plurality of envelope feed rollers 52. Shaft 51 is driven by the shaft 49 by means of a pulley 52*a* mounted on the shaft and having trained thereover an O-ring belt 52*b* which is also trained over shaft 49. Since the diameter of the pulley 52*a* is larger than the diameter of the shaft 49, shaft 51 will be driven at a slower speed. Each of the two outer rollers 52 may be serrated to enhance the gripping relation with the envelopes as were the rollers 50*a* and 50*c* on shaft 49. Similarly, the rollers 52 are made of a suitable elastomeric material and mounted on the shaft 51 for rotation with the shaft. Preferably, the rollers 50 and 52 are constructed such that the center bore receiving the shaft is slightly undersized relative to the shaft so that when the rollers are mounted on the shaft a frictional fit relationship will be obtained. Additionally, this structural arrangement is advantageous in that the rollers can be slidably adjusted along the shaft.

Coacting with the central envelope feed rollers **50*b* and 52 are upper opposed cylindrical guides 53 which are adjustably spaced from the lower driven rollers such as to limit the passage of a single envelope at a time from the magazine. The cylindrical guides 53 are fixed in position and non-rotatable and also constructed of a suitable elastomeric material. It may be appreciated that these guides need not be in cylindrical form as long as they provide the type of guiding action desired and which limits the flow of envelopes to a single envelope from the magazine. The guides are mounted between a pair of parallel spaced apart bars 54 which in turn are adjustably secured to a floating shaft 55. The floating shaft 55 is carried by a pair of cantilever arms 55*a* that are adjustably fixed to a tensioning shaft 56 by set screws 56*a***.

Figure 8:
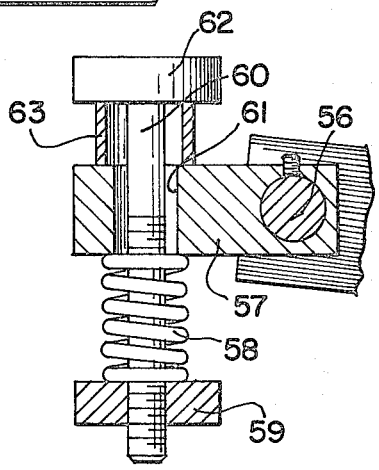
FIG. 8 is a greatly enlarged vertical sectional view taken through the adjusting mechanism for adjusting the position of the upper rollers at the outlet end of the magazine in accordance with the thickness of an envelope being fed to the press.

As seen particularly in FIG. 8 a tension lever 57 extends from the shaft 56 and is biased by a spring 58 to cause a downward biasing force on the floating shaft 55 and upper guides 53. The spring 58 is bottomed at its upper end against the tension lever 57 and at its lower end against a fixed lug or bar 59 that is suitably secured to the side rail 15. An adjusting bolt 60 extends freely through a guide hole 61 in the tension lever 57 and is threadedly engaged in a tapped hole formed in the fixed lug 59. The bolt 60 is provided with a head 62 and a spacer 63 is disposed between the head and the upper side of the tension lever 57. It may readily be appreciated that the combination adjusting bolt, spring and tension lever coact to precisely position the upper guides 53 relative the opposed lower feed rollers while allowing no downward movement thereof but allowing upward movement against the bias of spring 58. Inasmuch as the lower rollers **50*b* and 52 are in fixed position, adjustment of the positions of the upper guides 53** is accomplished in order to provide the desired distance between the rollers such that only a single envelope is fed along the conveyer from the magazine at any one time and to accommodate envelopes of different thicknesses.

The front wall 37 of the magazine is also supported on the floating shaft 55 by being fixed to the ends of bars 54 and adjustably movable with the guides 53. Set screws **54*a* permit the adjustable fixing of bars 54 to the floating shaft 55. Additional guide rollers 64 are mounted on the opposite sides of bars 54 and in overlying relation with belts 20*b* and 20*c*** to further assist in holding the envelopes against the conveyer belts.

In the operation of the metering device, it may be first appreciated adjustment would be made of the position of the upper guide members 53 with respect to the spacing between them and the opposed lower driven rollers **50*b* and 52 so that the type of envelope to be fed by the feeder mechanism to the duplicating machine will be metered one at a time from the bottom of the supply magazine to the feed stack at the output end of the machine. Thus, only one envelope at a time would be allowed through the gap defined by the lower feed rollers and the upper guide members. It is appreciated that the guide members are fixed, i.e., their peripheral surfaces do not move relative to the envelopes as the envelopes move between the lower feed rollers and the upper guide members. However, the envelopes easily slip by the upper guide members. The primary moving force of the envelopes comes from the belts 20 that form the bottom of the magazine and on which the lowermost envelope of the supply stack rests. The speed of the belts is determined by the driving speed of the motor 26. Inasmuch as the belts engage the guide rollers 50 on the shaft 49 and thereby drive those guide rollers at the same linear speed as the belts, the linear speed of the lower feed rollers 50*a*, 50*b* and 50*c*, which are of the same diametrical size as the guide rollers 50, will be equal to that of the belts. However, inasmuch as the shaft 51 on which the feed rollers 52 are mounted rotates at a slower speed than the shaft 49 on which the rollers 50 are mounted, some slippage will occur between the feed rollers 52 and/or the belts during the movement of an envelope from the magazine onto the inclined path going up to the output end of the feeder. The slower speed of rollers 52 prevents double feeding, i.e., the feeding of more than one envelope at a time. Thus, the feed rollers 52 coact with the feed rollers 50 to assure the feeding of a single envelope at a time from the magazine. Once the feed rollers move an envelope from the magazine to the point where guide and holddown rollers 68 engage the belts, the envelopes are gripped between rollers 68 and the belts and driven toward the output end at the belt speed and up the inclined portion of the belt conveyer to the feed stack. Thereafter, when the trailing end of an envelope leaves the slower feed roller 52, it can be appreciated that the next envelope will be timed to move slower toward the feed rollers 50** so that it can be assured that the next envelope will not be fed onto the preceding envelope and cause double feeding.

The lower run of the conveyer belts is supported intermediate the input and output ends of the feeder by means of a transversely extending rod 67 mounted between the opposed side rails and over which the belts are directed. Immediately upstream from the rollers 50 and 52 is disposed a further set of overhead envelope holddown rollers 68 mounted on a cross shaft 69 rotatably carried by the side rails. Upstream from the rollers 68 is another set of overhead envelope holddown rollers 70 mounted on a cross shaft 71. It will be appreciated that envelope guide rollers 68 and 70 maintain the envelopes in engaging relation with respect to the belts 20 and are spaced apart from the input and output ends such that at all times an envelope will be engaged by one of the rollers as it moves toward the feed stack at the output end of the feeder.

It is critical that the upper runs of the conveyer belts extend upwardly from the input end **10*a* to the output end 10*b* so that the envelopes can positively and easily stack from the bottom at the output end as the envelopes are removed from the top. As noted particularly in FIGS. 2 and 4, the upper run of the conveyer belts 20 is again disposed to form the bottom of the feed stack at the outlet end of the envelope feeder. The belts are also positioned so that the leading edges of the envelopes will strike and be stopped by an upstanding vertical wall 74 carried by the duplicating press 11. When the envelope feeder is positioned with respect to and mounted on the duplicating press, the side rails 15 and 16 are placed in abutting relation to this stop wall 74** so that the feed stack at the output end is automatically aligned with the suction feeder of the duplicating press.

The formation of the bottom wall of the stacker at the output end by virtue of the conveyer belts is determined at the drive roller 22 by the position of the drive roller along the vertical end near the trailing edges of the envelopes by means of a belt guide 75 spaced rearwardly of the rollers 22. The position of the belt guide is adjustable in the same fashion as the rear belt guide 48 at the magazine 36 in order to place it slightly inward from the trailing edges of the envelopes so that the trailing edges project rearwardly above the inclined portion of the conveyer belts leading to the belt guide. The manner in which the belt guide 75 is supported on the side rails may be like the manner in which the belt guide 48 is supported where it may be provided with blocks at opposite ends and which may optionally include pins to engage in holes in the side rails to maintain a desired position.

The feed stack formed at the output end of the feeder is positioned between the opposite side rails by means of opposed upstanding guide plates 76 and 77 and against the stop wall 74. These guide plates are adjustably supported on a transversely extending support plate 78 which in turn is secured at opposite ends to the side rails 15 and 16. Moreover, this support plate is provided with a slot for receiving fasteners associated with the guide plates so that they may be adjustably spaced transversely along the support plate in the same manner as side walls 39 and 40 of magazine 36. The forward edges of guide plates 76 and 77 are flared to facilitate guiding of the envelopes therebetween. Thus, guide plates 76 and 77, together with stop wall 74, define a magazine for storing a supply of envelopes at the outlet end for the suction feeder. The number of envelopes stored here is small, as each one must be within range of the suction feeder stroke. A sufficient number is provided such that slight interruptions of envelope feed to the feed stack will not interfere with the suction feeder picking up an envelope on each stroke.

Figure 3:
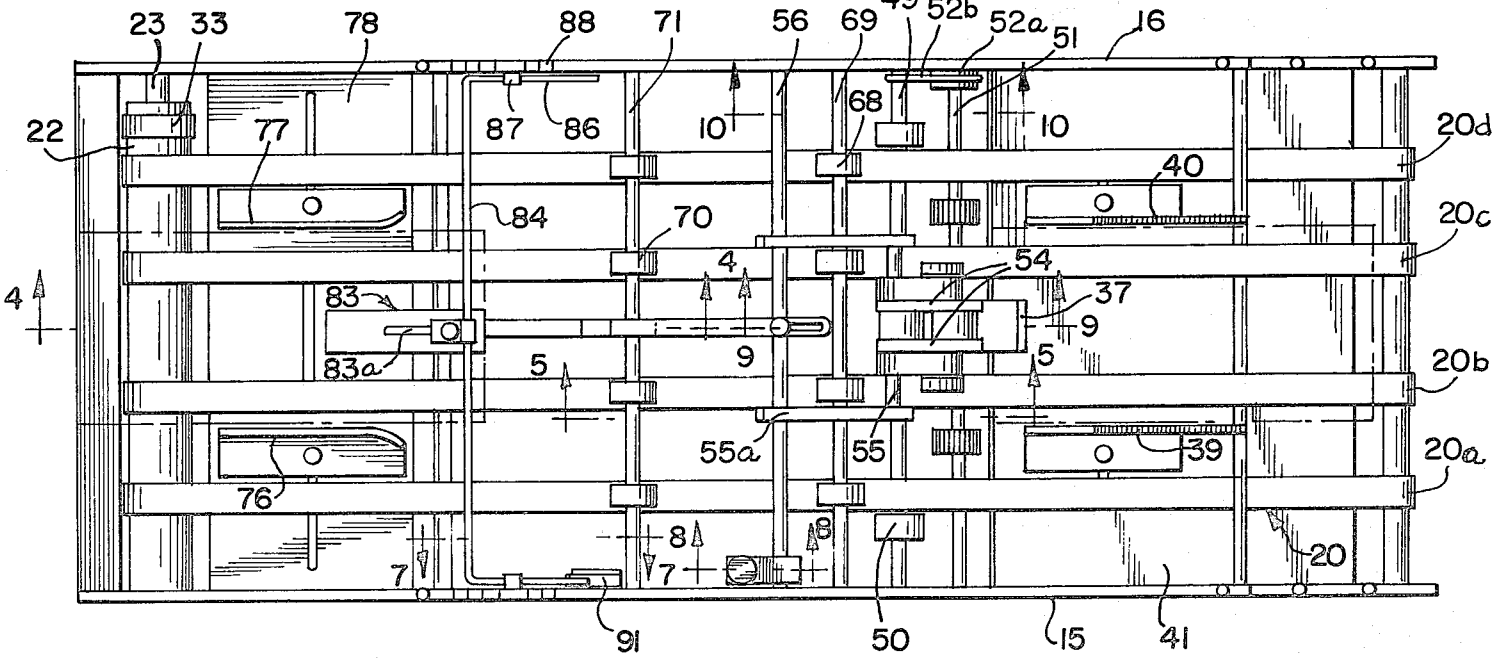
FIG. 3 is a top plan view of the envelope feeder of FIG. 1 with the envelopes being shown only in phantom.

Once the envelopes are delivered by the conveyer to the feed stack at the output end of the feeder, they are prevented from moving back toward the input end of the feeder by means of a vertically extending stop 81 formed on the end of an adjustably positioned spring finger 82 which extends longitudinally of the feeder and which is adjustably secured at its end near the magazine on the shaft 56, as seen most clearly in FIG. 3 to accommodate envelopes of different sizes. A pair of spring fingers may be used in place of a single finger.

The height of the feed stack at the output end is maintained at such a level that there will always be an envelope in position for the suction feeder of the duplicating press. A floating stack height detector or stack thickness detector 83 senses the thickness of the stack and shuts down the conveyer when the stack has reached a predetermined maximum thickness. Likewise, it reenergizes the conveyer when the thickness decreases a predetermined amount. This detector is in the form of a finger or plate 83*a* adjustably mounted on a transversely extending wire member 84 by a clamp assembly 85 having a clamp 85*a* selectively locked to the plate or bar 83*a* and the wire member 84 by a nut and bolt fastener 85*b*. Plate 83*a* is slotted at 83*b*. Thus, the plate or finger 83*a* may be adjustably positioned toward and away from the outlet end of the feeder and transversely between the side rails to accommodate stock of various sizes. Preferably, as shown in FIG. 4, the plate 83*a* is mounted at an incline so that it generally engages the topmost envelope at its forward end only.

Figure 7:
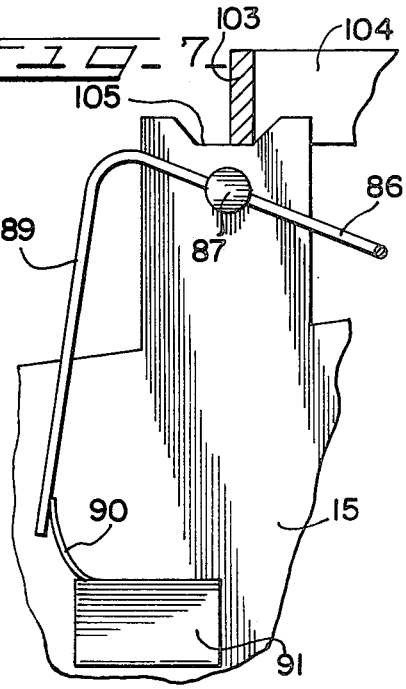
FIG. 7 is an enlarged elevational detailed view taken toward the inside of one of the side plates of the feeder to show the mechanism for controlling the limit switch that is operable by the stack height at the feed stack.

Wire member 84 is carried by support arms 86 which are adjustably or fixedly received in stub shafts 87 that are pivotally mounted on upward extensions 88 of the side rails 15 and 16. One of the support ends 86 is provided with a downwardly extending switch actuating arm 89 for engagement with a switch lever 90 of a limit switch 91 mounted on the inside of side rail 15, as seen particularly in FIGS. 3 and 7. This limit switch is suitably interconnected into the power input circuitry of the motor 26 so that it can control operation of the motor depending upon the height of the feed stack. When the stack reaches a predetermined miximum height, the switch detector will rise by the force of the envelopes and actuate the limit switch 91 to de-energize the motor 26 and stop the conveyer 20 and the feed of envelopes from the supply stack. Likewise, when the height of the stack decreases to a predetermined level, the stack detector will gravitationally lower and actuate the switch 91 to cause reenergization of the motor 26 and further feeding of envelopes from the supply stack to the feed stack. The stack detector also serves as a holddown for the feed stack and applies sufficient pressure to assure travel of the lowermost envelope to the stop position against stop wall 74.

Figure 4:
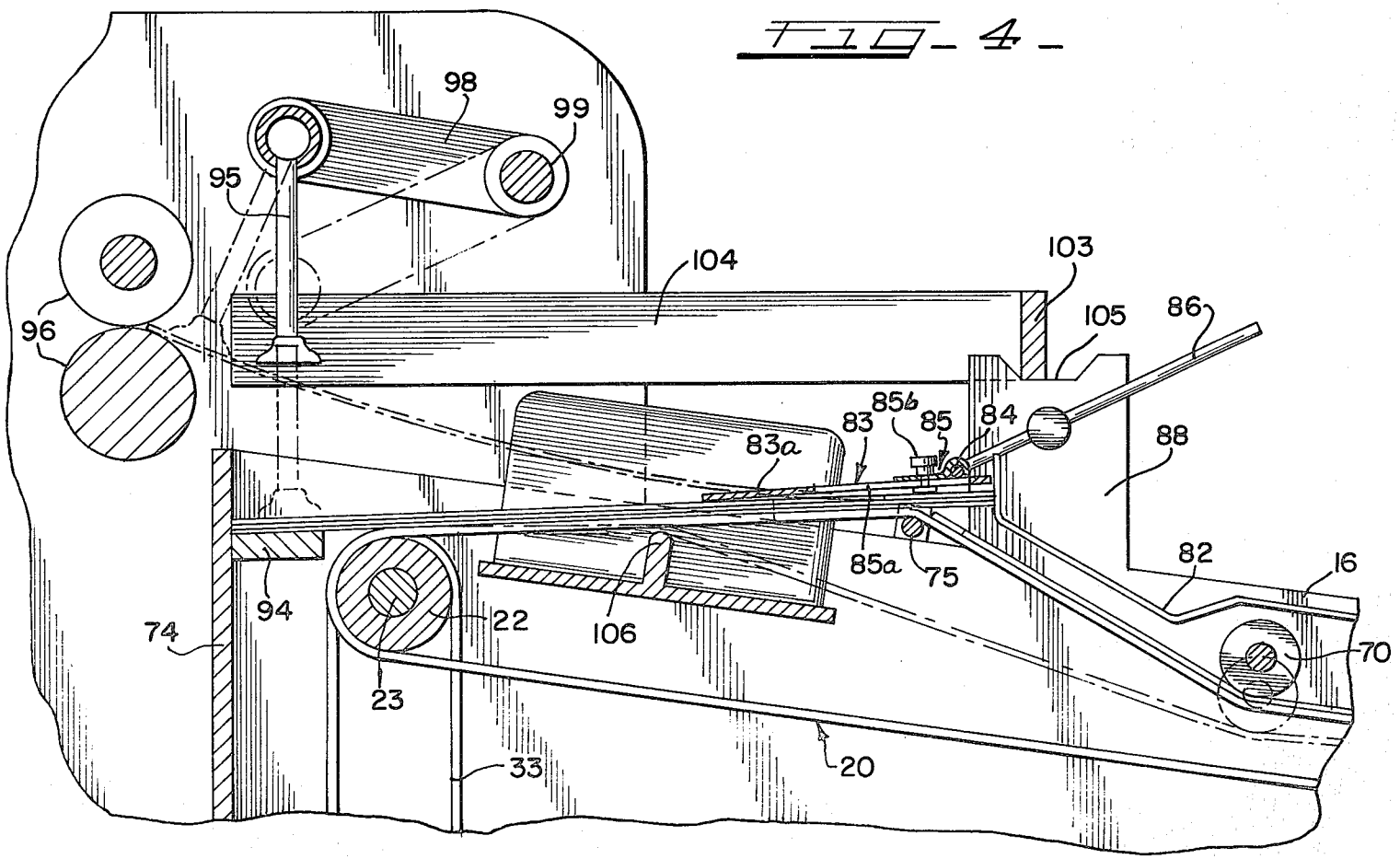
FIG. 4 is a greatly enlarged longitudinal sectional view taken through the feeder at the output end and illustrating the manner in which it provides a stack of envelopes for the suction feeder of the duplicating press.
Figure 5:
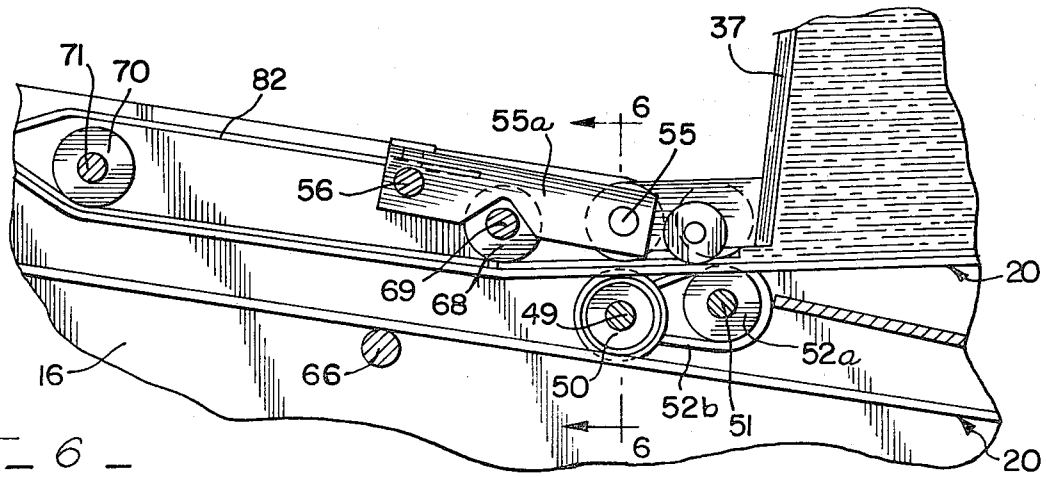
FIG. 5 is a greatly enlarged longitudinal sectional view taken through the feeder of the invention at the outlet end of the magazine storing the supply stack to illustrate the manner in which the envelopes are fed one at a time between the supply stack and the feed stack.
Figure 6:
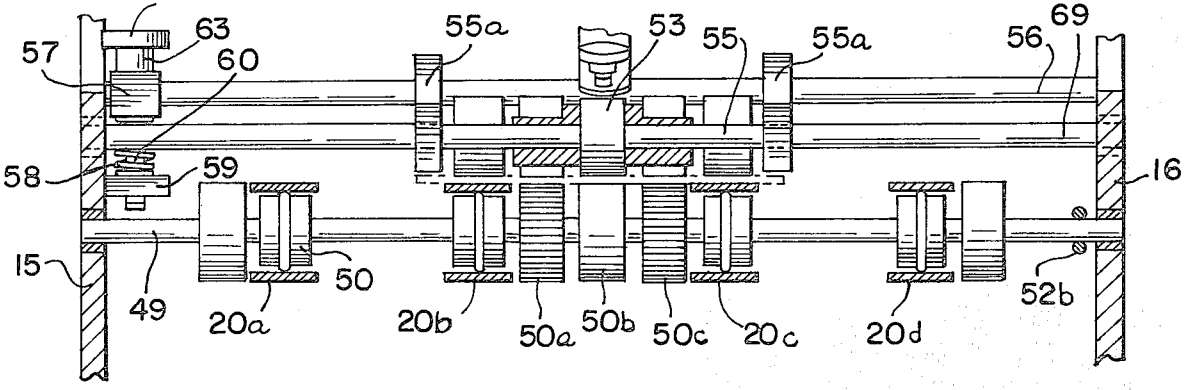
FIG. 6 is a transverse sectional view taken substantially along line 6—6 of FIG. 5.
Figure 9:
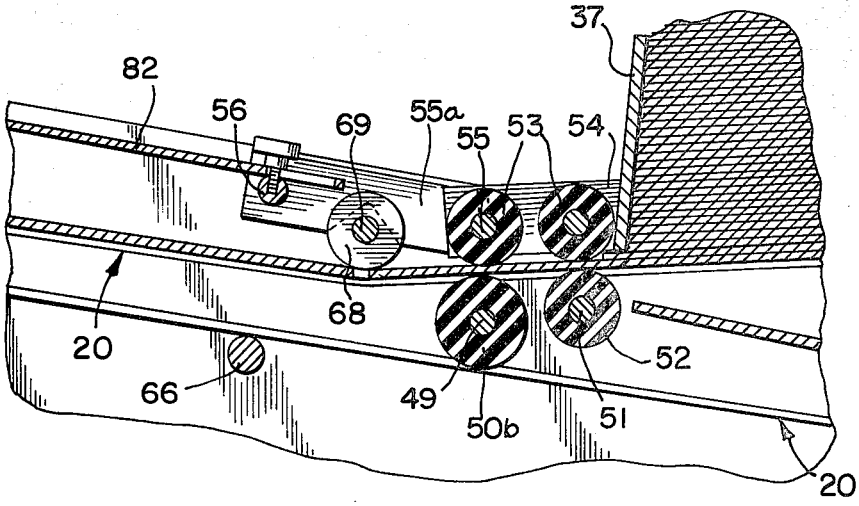
FIG. 9 is a vertical sectional view taken substantially along line 7—7 of FIG. 3 illustrating the structure for metering the discharge of envelopes from the supply magazine.
Figure 10:
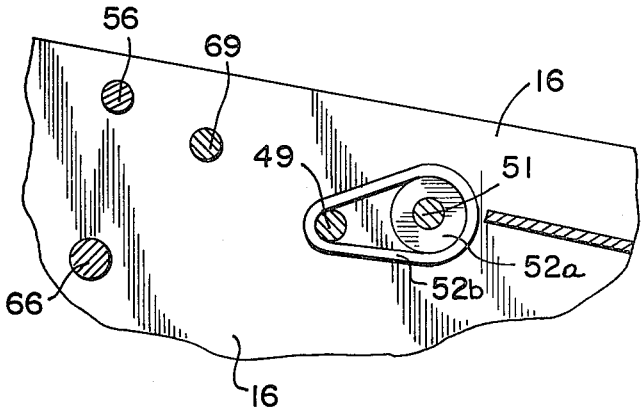
FIG. 10 is a vertical sectional view taken substantially along line 10—10 of FIG. 3 showing the drive connection between the lower driven shafts at the supply magazine.

As seen particularly in FIGS. 2 and 4, the manner in which the envelope is removed from the top of the feed stack is illustrated. Envelopes are aligned at their forward leading edge by the vertical stop wall 74 of the duplicating press. At this position, the forward portion of the envelopes is positioned over a fixed backup plate 94 that extends between and is mounted at opposite ends to the side rails 15 and 16. The suction fingers or feet 95 of the duplicating press come down to the top of the feed stack to engage the topmost envelope. It may be appreciated that the envelopes come to a complete stop before being picked up by the suction fingers. The backup plate 94 assures that the suction feet obtain a firm engagement with the topmost envelope as they move into gripping position. The action of the suction fingers 95 is such that it will first lift the topmost envelope directly upward and then ahead sliding it from under the plate 83*a* and into the bite of printing rollers 96. The feeder is mounted on a cross shaft 97 which is in turn mounted at opposite ends on arms 98 carried by an oscillating cross shaft 99. It will be appreciated that the envelope feeder of the invention is useful for those duplicating presses having a top loading suction feeder of the type illustrated.

Envelope feeders heretofore known are floor supported relative to the duplicating press with which it coacts. The feeder of the present invention is of much simpler construction and is mounted directly to the duplicating press between the vertically movable stack platform 102 and a transversely extending support or cross bar 103. The support bar 103 is cantileverly supported from the duplicating press by opposed arms 104 which are connected directly to the press in a suitable manner. The bottom edges of the side rails 15 and 16 bear against the vertically movable stack platform 102, as seen particularly in FIGS. 1 and 2, while the upper ends of the upward extensions 88 are notched at 105 to receive the support bar 103, as seen particularly in FIGS. 1, 2 and 4. The opposite edges of the notches are inclined to assist in guiding the cross bar 103 into the notch and properly align the output end of the feeder with the suction feeder of the press. It may be readily appreciated that when mounting the feeder of the invention onto a duplicating press, it is first positioned on the vertically movable stack platform 102 and against the stop wall 74 when the stack platform is at a lower position to allow the extensions 88 to move in a non-interfering manner by the support bar 103. Once the feeder is in position, the stack platform is moved upwardly until the extensions 88 engage the support arm 103, thereby locking the feeder in position on the duplicating press. It may be appreciated that this mounting procedure will only take a few seconds, and thereafter the feeder is ready to be operated with the duplicating press. Similarly, removal of the feeder from the duplicating press requires only a few seconds as it is only necessary to lower the vertically movable stack platform 102 so that the extension 88 disengages from the support bar 103. It may therefore be appreciated that the feeder of the invention may be moved from one duplicating press to another quickly and easily with a minimum amount of time involved.

In view of the foregoing, it is seen that the feeder of the invention is simple and economical in construction and can be quickly and easily placed into service with a duplicating press without requiring the necessity of timing its operation with the press. It would only be necessary to hand or otherwise load the magazine with envelopes and turn on the feeder to generate the feed stack at the outlet end. Thereafter, the press may be started.

Moreover, the feeder of the invention is easily adjustable to handle envelope stock of various sizes, as seen in FIG. 4 where it may be desired to use the feeder with short envelopes. The belt guide 75 may be removed and the belts then allowed to engage a belt guide 106 carried by the support plate 78. Alternatively, guide 106 may be replaced by a transversely extending rod positioned closer to the drive roller 22. When the belts are at this level, the holddown rollers 70 are also lowered, as shown in phantom. To adjust for wider envelopes, the side walls 39 and 40 of the magazine 36 can be moved to the outside of the outermost belts 20*a* and 20*d*, thereby bringing into operation all of the conveyer belts. For additional envelope width, the rollers may be slid along the shafts to provide the desired feed action. Additional rollers may be added to the shafts as needed. Also, additional upper guide members and lower feed rollers may be added in tandem to provide the desired control of envelope movement so that coaction between the rollers limits single envelope discharge.

It will be understood that modifications and variations may be effected without departing from the scope of the novel concepts of the present invention, but it is understood that this application is to be limited only by the scope of the appended claims.

The invention is hereby claimed as follows:

1. An envelope feeder for a duplicating press having a suction envelope feeder, said feeder comprising an input end where envelopes are stored in stacked relation and an output end where envelopes are stacked to be fed by the suction feeder into the press, a magazine at the input end for receiving a supply stack of envelopes and a magazine at the outlet end for storing a feed stack of envelopes in alignment with the suction feeder, a conveyer for removing envelopes from the bottom of the supply stack and conveying them to the feed stack and defining the bottoms for both of said magazines, said conveyer having an upwardly inclined path between the magazines such that the envelopes are fed to the bottom of the feed stack, metering means at the magazine at the input end for feeding one envelope at a time from the supply stack to the feed stack, and means at the output end magazine for detecting the height of the feed stack and stopping the conveyer when the stack has reached a first given height and starting the conveyer when the stack diminishes to a second given height.

2. The envelope feeder defined by claim 1, wherein said magazine at the input end includes a forward wall and two opposed side walls, and all of said walls being adjustably mounted to accommodate envelopes of various sizes.

3. The envelope feeder defined by claim 2, wherein said magazine at the output end includes two adjustably mounted opposed guide plates with flared edges at the inlet ends.

4. The envelope feeder defined by claim 1, wherein said conveyer includes a plurality of belts.

5. The envelope feeder defined by claim 4, which further includes belt guide and envelope holddown rollers mounted between said magazines to guide the movement of envelopes between the supply stack and the feed stack and spaced apart such that an envelope is always in engagement with a holddown roller during movement from the magazines.

6. The envelope feeder defined by claim 1, wherein said means coacting with the magazine at the input end and the conveyer to feed one envelope at a time includes at least one set of lower roller over which the belts ride and a set of upper guides in opposed relation to the lower rollers and to a position slightly spaced above the belts, and means for adjustably and resiliently biasing the upper guides to said position.

7. The envelope feeder defined by claim 1, wherein said feed stack height detecting means includes a plate adapted to engage the uppermost envelope of the feed stack, means adjustably mounting said plate to accommodate envelopes of various sizes, and a switch actuable by said plate to control operation of the conveyer.

8. An envelope feeder for a duplicating press having a suction envelope feeder, said feeder including an input end for receiving a supply of envelopes and an output end from which the envelopes are transferred by the suction feeder to the press, means at the input end for storing a stack of envelopes, means at the output end for storing a stack of envelopes, means for continuously transferring envelopes from the bottom of said input end stack to the bottom of said output end stack, means coacting with said input end storing means and said transfer means to feed one envelope at a time from the input end stack to the output end stack, and means at said output end for stopping said transfer means when said output end stack reaches a predetermined maximum height.

9. The envelope feeder of claim 8, which is constructed to be easily mounted directly on the duplicating press and which includes a pair of vertical parallel spaced side rails having horizontal lower edges adapted to be supported on a vertically movable stack platform of the press and inclined upper edges with notched extensions that are adapted to engage a fixed cross bar of the press, whereby mounting of the feeder comprises setting the feeder onto the movable stack platform and against a vertical stop wall and raising the platform so that the cross bar is engaged by said notched extensions.

10. The envelope feeder of claim 8, wherein the transfer means includes a belt conveyer inclined upwardly from the input end to the output end.

11. The envelope feeder of claim 10, wherein said belt conveyer includes a plurality of spaced parallel running belts.

12. The envelope feeder of claim 11, wherein said belts are trained over a plurality of rollers carried on shafts rotatably mounted on said side rails.

13. The envelope feeder of claim 12, wherein said rollers are slidable on said shafts for adjusting the path of travel of the belts.

14. The envelope feeder of claim 13, wherein said rollers are of elastomeric material.

15. The envelope feeder of claim 14, wherein at least some of the rollers are peripherally serrated to enhance the gripping action with the envelopes.

* * * * *

UNITED STATES PATENT AND TRADEMARK OFFICE

CERTIFICATE OF CORRECTION

PATENT NO. : 4,478,400

DATED : October 23, 1984

INVENTOR(S) : Louis P. Commers

It is certified that error appears in the above—identified patent and that said Letters Patent is hereby corrected as shown below:

Col. 8, line 10, change "miximum" to --maximum;
Col. 9, line 53, delete "envelope" before the first occurrence of "feeder" and insert --envelope-- before the second occurrence of "feeder";
Col. 10, line 26, change "roller" to --rollers--;
line 38, delete "envelope" before the first occurrence of "feeder" and insert --envelope-- before the second occurrence of "feeder".

Signed and Sealed this

*Twentieth* Day of *August 1985*

[SEAL]

*Attest:*

DONALD J. QUIGG

*Attesting Officer*

*Acting Commissioner of Patents and Trademarks*